United States Patent [19]

Vogt

[11] Patent Number: 4,620,470

[45] Date of Patent: Nov. 4, 1986

[54] FINGERBOARD FOR STRINGED INSTRUMENTS

[76] Inventor: Walter J. Vogt, Pfarrer-Egen-Weg 11, 7240 Horb-Mühlen, Fed. Rep. of Germany

[21] Appl. No.: 726,510

[22] Filed: Apr. 24, 1985

[30] Foreign Application Priority Data

May 12, 1984 [DE] Fed. Rep. of Germany ..... 3417721

[51] Int. Cl.[4] ..... G10D 3/06

[52] U.S. Cl. ..... 84/314 R

[58] Field of Search ..... 84/267, 293, 312 R, 84/314 R

[56] References Cited

U.S. PATENT DOCUMENTS

| | | | |
|---|---|---|---|
| 922,765 | 5/1911 | Garrett | 84/314 |
| 3,290,980 | 12/1966 | Fender et al. | 84/307 |
| 3,469,489 | 9/1969 | Barth | 84/314 R |
| 3,599,524 | 8/1971 | Jones | 84/312 |
| 3,894,468 | 7/1975 | Dunlap | 84/314 R |
| 4,137,813 | 2/1979 | Stone et al. | 84/314 |

FOREIGN PATENT DOCUMENTS

| | | |
|---|---|---|
| 884812 | 1/1980 | Belgium . |
| 235785 | 11/1910 | Fed. Rep. of Germany . |
| 440661 | 2/1912 | France . |

OTHER PUBLICATIONS

*De Gitaar,* 1979, p. 40, col. 3, line 28 to p. 41, col. 1, line 13.

*Primary Examiner*—Lawrence R. Franklin
*Attorney, Agent, or Firm*—Pahl, Lorusso & Loud

[57] ABSTRACT

The invention relates to a fingerboard for stringed instruments, especially guitars, comprising transversely extending frets for varying the pitch of taut strings extending lengthwise over the fingerboard. In order to improve tuning of the instrument, the frets are divided into fret elements in the region of the individual strings extending thereover. The fret elements are individually adjustable on the fingerboard in the longitudinal direction of the strings.

6 Claims, 4 Drawing Figures

FINGERBOARD FOR STRINGED INSTRUMENTS

The invention relates to a fingerboard for stringed instruments, especially guitars, comprising transversely extending frets for varying the pitch of taut strings extending lengthwise over the fingerboard.

Known fingerboards of this type have frets extending over the fingerboard in a straight line and in one piece. The space between the frets and the bridge of the stringed instrument is the same for all the strings stretched over these frets. With respect to pitch, the bridge forms the starting point of the string. When the string is pressed against a particular fret it is capable of sounding at a specific pitch. The spaces between the individual frets and between the frets and the bridge have, up to now, been established mathematically or graphically. These spacing values have proven, however, to be incompatible with the correct acoustic values and so compromises have had to be made when tuning the string; a very fine tuning was not possible, especially outside the range of tempered tuning. It was not possible, in particular, to distinguish between sharp and flat tones, for example D sharp and E flat. It was also found that the pitches varied from one set of strings to the next when using conventional fingerboards with straight, one-piece frets. Differences were also noticed when changing from one make of string to another. Finally, the strings gradually become worn when the instrument is played, for example notches may be formed in the region of the frets which will also interfere with tuning. In this case, it has again been impossible, up to now, to achieve an exact subsequent tuning string by string.

The object underlying the invention is to design a fingerboard of the type in question for stringed instruments, especially guitars, such that a very fine and acoustically exact tuning is possible from string to string and from key to key.

This object is accomplished in accordance with the present invention in that in the region of the individual strings extending thereover the frets are divided into fret elements and these elements are adjustable on the fingerboard in the longitudinal direction of the strings.

The following description of a preferred embodiment of the invention serves to explain the invention in greater detail in conjunction with the attached drawings, in which FIG. 1 is a diagrammatic view of a guitar;

Figure 1:
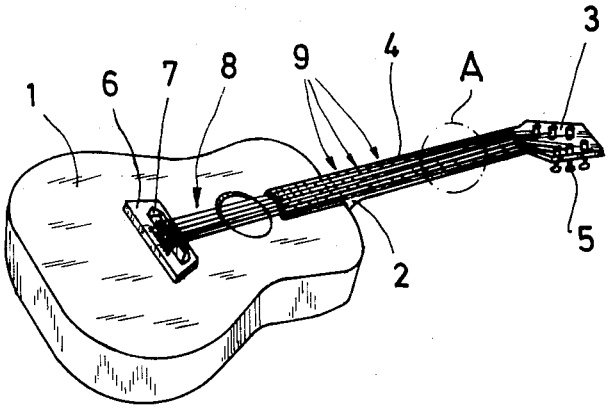

The guitar illustrated in FIG. 1, which is a typical stringed instrument, comprises in the known manner a sound box 1, from which a neck 2 with a schematically illustrated pegbox 3 projects. The fingerboard 4, which is usually black, extends along the neck 2 and for a certain distance over the sound box 1. Six strings 8 are strung between pegs 5 rotatably mounted on the pegbox 3 and a string holder 6 with a bridge 7. The strings may be tuned to various pitches with the aid of the pegs 5. The tone of each string may be varied (raised) when the string is pressed against one of a plurality of frets 9 extending across the fingerboard and the string thereby shortened.

Figure 2:
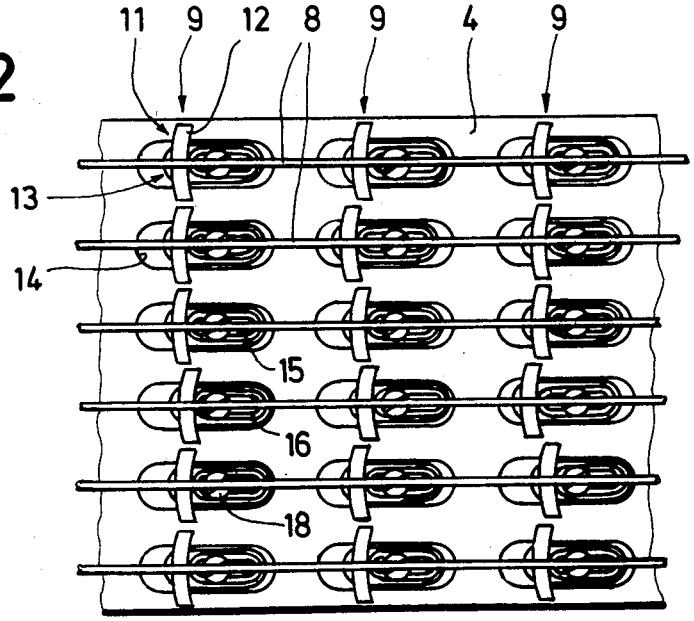
FIG. 2 shows a detail in area A of FIG. 1.

The inventive fingerboard illustrated in FIG. 2 has frets 9 which extend across the fingerboard 4 in spaced relation to one another and are designed as individual fret elements 11. A single taut string 8 extends over each fret element in the finger region of a specific tone. The individual fret elements 11 are individually adjustable on the fingerboard 4 in the longitudinal direction of the strings. This enables each string to be individually tuned to any tone. The tuning of the instrument is therefore very exact and will satisfy the respective requirements.

As illustrated, the individual fret elements of the preferred embodiment of the invention do not extend in a straight line but are curved. The centre of curvature lies preferably on the side of the fret element facing the pegbox 3. It has been found that the strings are laterally distorted when pressed down in particular during the playing of notes having a difficult fingering. Each distortion of a string does, however, sharpen the tone. This increased tension on the string is compensated by the curvature of the fret elements 11. The curvature of the fret elements will also enable the strings not to wear at the same places as quickly as with straight frets. Wear on the strings is, in the present case, spread over a greater area which increases the durability of the string and its purity of tone.

Figure 3:
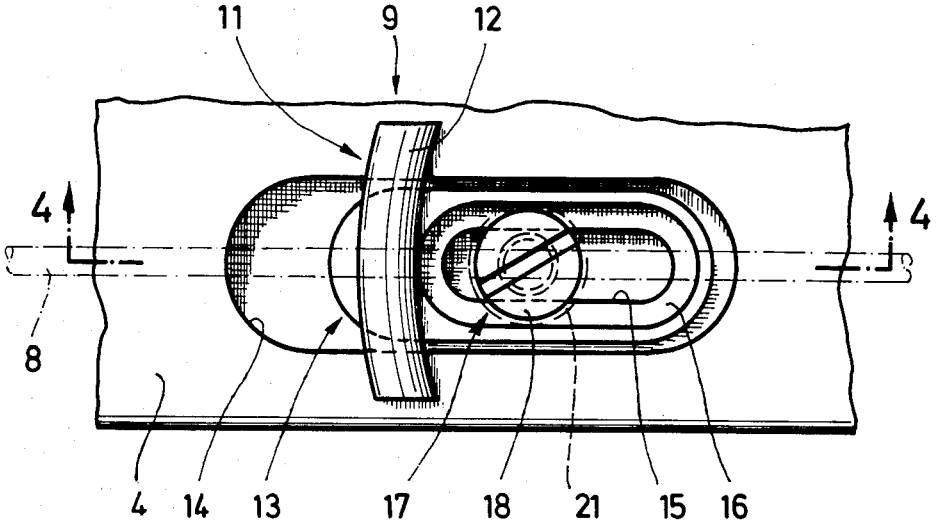
FIG. 3 is a plan view of a single fret element.
Figure 4:
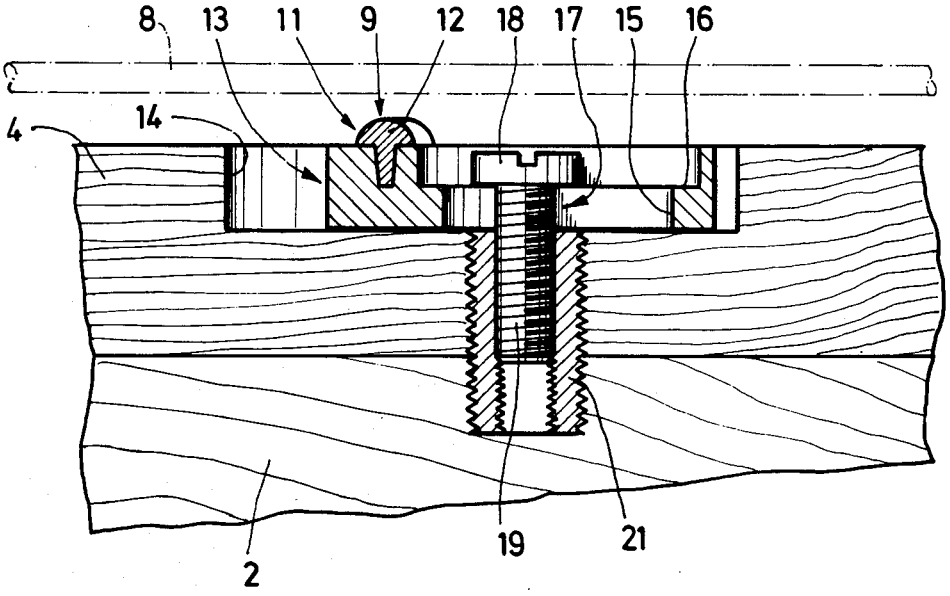
FIG. 4 is a cross-sectional view along line 4—4 in FIG. 3.

FIGS. 3 and 4 will now be used to explain how the fret elements 11 are individually adjustable in the preferred embodiment of the invention. Each fret element 11 comprises a (curved) relatively shot crosspiece 12 having a semicircular cross-sectional shape (FIG. 4), on which the string 8 abuts when the corresponding tone is played. The crosspiece 12 is rigidly connected with an elongated slider 13, for example due to their construction in one piece or due to soldering. The crosspiece 12 and the slider 13 consist preferably of metal. The underside of the crosspiece 12 may rest on the fingerboard laterally of the slider 13. This slider 13 is disposed for sliding displacement in a groove 14 extending lengthwise of the fingerboard 4 and has an elongated hole 15 surrounded by a step-like shoulder 16. A screw 17 extends through the elongated hole 15 substantially at right angles to the fingerboard 4. The head 18 of this screw rests on the shoulder 16 and its shaft 19 is screwed into a threaded bushing 21 mounted in the fingerboard 4 and the neck 2 of the guitar. Once the screw 17 has been loosened, the slider 13 and with it the crosspiece 12 may be adjusted according to the desired pitch. The fret element 11 is secured in position at the tuned pitch by tightening the screw 17.

It has been found that use of the individually adjustable fret elements described enables guitars and other stringed instruments to be tuned to a fineness and purity of tone not previously achieved. The inventive fret elements are suitable for stringed instruments of all kinds, i.e. apart from guitars for lutes in particular, for which the fret elements are preferably made of non-metallic materials, preferably plastics.

The inventive fret elements may also be used for bowed stringed instruments, such as the viola da gamba, insofar as these are provided with frets on the fingerboard.

I claim:

1. A fingerboard for stringed instruments, especially guitars, comprising transversely extending fret elements for varying the pitch of taut strings extending lengthwise over a fingerboard, whereby each fret element is arranged on a slider and is individually displaceable in the longitudinal direction of the strings in grooves of the fingerboard, characterized in that, each slider has an elongated hole extending parallel to the strings, and that the shaft of a locking screw with a head is fixed rotatably in the fingerboard, whereby the screw shaft penetrates the elongated hole and the screw head extends laterally above the elongated hole, so that the slider with its fret element is fixed onto the fingerboard when the locking screw is screwed in and that it is displaceable on the fingerboard when the locking screw is unscrewed in order to thus be able to precisely adjust the desired pitch of a string extension over the fret element.

2. Fingerboard as defined in claim 1, characterized in that the fret elements are designed as curved crosspieces.

3. Fingerboard according to claim 2, characterized in that the crosspiece projects laterally above the slider and rests with its underside against the fingerboard.

4. Fingerboard according to claim 1, characterized in that the elongated hole is surrounded on all sides by a shoulder against which the screw head of the locking screw rests.

5. Fingerboard as defined in claim 1, characterized in that the locking screw engages in a threaded bushing secured in the fingerboard.

6. Fingerboard according to claim 1, characterized in that the fret element and the slider are fabricated in one piece out of metal.

* * * * *